US007495684B2

(12) United States Patent
Nakano

(10) Patent No.: US 7,495,684 B2
(45) Date of Patent: Feb. 24, 2009

(54) PRINTER

(75) Inventor: Satoshi Nakano, Daito (JP)

(73) Assignee: Funai Electric Co., Ltd., Osaka (JP)

( * ) Notice: Subject to any disclaimer, the term of this patent is extended or adjusted under 35 U.S.C. 154(b) by 401 days.

(21) Appl. No.: 11/325,042

(22) Filed: Jan. 4, 2006

(65) Prior Publication Data

US 2006/0146113 A1 Jul. 6, 2006

(30) Foreign Application Priority Data

Jan. 4, 2005 (JP) ..... 2005-000135

(51) Int. Cl.
*B41J 2/385* (2006.01)
*B41J 29/02* (2006.01)
*H04L 9/00* (2006.01)

(52) U.S. Cl. ..... 347/170; 347/164; 380/52; 400/693; D18/11

(58) Field of Classification Search ..... 347/164, 347/170; D18/11; 380/52; 400/693
See application file for complete search history.

(56) References Cited

U.S. PATENT DOCUMENTS 6,064,843 A * 5/2000 Isobe et al. ..... 399/111
6,367,666 B1 * 4/2002 Hou et al. ..... 222/386.5
6,568,788 B2 * 5/2003 Shimizu et al. ..... 347/30
6,654,133 B2 * 11/2003 Inoue et al. ..... 358/1.12
6,758,558 B2 * 7/2004 Chiu et al. ..... 347/86
6,913,340 B2 * 7/2005 Tanaka et al. ..... 347/29
2003/0128261 A1 * 7/2003 Usui et al. ..... 347/86
2005/0195264 A1 * 9/2005 Sootome et al. ..... 347/104

FOREIGN PATENT DOCUMENTS

JP 55-61629 4/1980
JP 63-116439 7/1988
JP 2001-295875 10/2001

OTHER PUBLICATIONS

Partial English Translation of Application No. 63-116439, dated Jul. 27, 1988 (2 pages).
Partial English Translation of Application No. 55-61629, dated Apr. 26, 19890 (2 pages).
Patent Abstracts of Japan, Publication No. 2001-295875, dated Oct. 26, 2001 (1 page).

* cited by examiner

*Primary Examiner*—Stephen D Meier
*Assistant Examiner*—Sarah Al-Hashimi
(74) *Attorney, Agent, or Firm*—Osha • Liang LLP

(57) ABSTRACT

A printer that can reduce a manufacturing cost is obtained. The printer according to the invention includes a casing as a base member, a movable member and a spring. The movable member is movable with respect to the casing. The spring is located between the casing and the movable member. The casing is provided at a position opposed to the lower end of the spring with a projected portion (circular convex portion) arranged to pinch the lower end of the spring. The position of the spring with respect to the casing is fixed by the state in which the lower end of the spring is arranged radially inside the circular convex portion. The movable member is provided at a position opposed to the upper end remote from the lower end of the spring with a fixing portion (projected fixing portion) for fixing the upper end of the spring.

11 Claims, 11 Drawing Sheets

PRINTER

BACKGROUND OF THE INVENTION

1. Field of the Invention

The present invention relates to a printer, and particularly to a printer including a movable member which is biased by a spring with respect to a base member.

2. Description of the Background Art

A printer having a structure for restricting a delivery position of printing sheets of paper in a paper feed cassette has been known, and particularly a printer having such a structure has been known that a movable member bearing printing sheets in the paper feed cassette is lifted by springs from a bottom wall of the cassette for determining a position of the printing sheets in a direction of lifting the printing sheets from the bottom wall of the paper feed cassette (e.g., Japanese Utility Model Laying-Open No. 63-116439).

In Japanese Utility Model Laying-Open No. 63-116439, a cassette body is provided at its bottom wall with an engagement portion for engaging with an end of the spring, and is also provided at the bottom wall with an aperture for fitting to a convex portion formed on the spring. According to Japanese Utility Model Laying-Open No. 63-116439, an end of the spring is kept in engagement with the engagement portion of the bottom wall of the cassette body, and the convex portion of the spring kept in the above engaged state is inserted into the aperture at the bottom wall by utilizing an elastic force of the spring so that the spring can be fixed to the bottom wall.

According to the above structure, the aperture is formed at the cassette body for inserting the convex portion of the spring. This aperture connects the upper and lower surfaces of the bottom wall of the cassette body together. It may be desired to isolate the upper and lower surfaces of the bottom wall of the cassette body from each other by the bottom wall for example in such cases that the bottom wall form a part of a bottom wall of a casing of the printer and that it is desired to isolate inner and outer spaces of the cassette from each other for suppressing absorption of external moisture into the printing sheets inside the cassette. In these cases, it is necessary to close the aperture by another member. This increases the number of components of the printer, and consequently increases a manufacturing cost of the printer.

According to the above structure, the convex portion must be formed at the spring. For arranging the spring on the cassette body, the spring end must be engaged with the engagement portion of the cassette body, and the convex portion of the spring must be inserted into the aperture of the cassette body. Thus, relatively complicated processing and operations are required. These complicate manufacturing steps of the printer, and increase the number of the manufacturing steps of the printer. This also increases the manufacturing cost of the printer.

SUMMARY OF THE INVENTION

An object of the invention is to provide a printer that can be manufactured at a reduced cost.

A printer according to the invention includes a casing, a movable member and a coil spring. The movable member is arranged on a bottom wall of the casing. The movable member is employed for restricting a transportation path of printing sheets. The coil spring has a conical form, and is located between the casing and the movable member. The coil spring is employed for biasing the movable member away from the bottom wall. The casing is provided at the bottom wall with a projected portion projected toward the coil spring and located at a position opposed to one end of the spring having a larger width. The projected portion has an annular plane form. The one end of the coil spring is arranged radially inside the projected portion to fix the position of the coil spring with respect to the casing. The movable member is provided with a fixing portion at a position opposed to the other end of the coil spring remote from the one end. The fixing portion is employed for fixing the other end of the coil spring. The fixing portion formed at the movable member is a convex portion projected toward the coil spring and having a circular plane form extending along a plane form of an inner periphery of the other end of the coil spring. The movable member is connected to the coil spring with the convex portion inserted into the coil spring.

A printer according to the invention includes a base member, a movable member and a spring. The movable member is movable with respect to the base member. The spring is located between the base member and the movable member. The spring is employed for biasing the movable member away from the base member. The base member is provided at a position opposed to one end of the spring with a projected portion projected toward the spring and located to pinch the one end of the spring. The pinching of the one end of the spring by the projected portion fixes the position of the spring with respect to the base member. The movable member is provided at a position opposed to the other end of the spring remote from the one end with a fixing portion for fixing the other end of the spring.

According to the invention, as described above, the spring is fixed at its two portions to the projected portion of the base member and the fixing member of the movable member, respectively. Therefore, it is not necessary to form an aperture or the like for fixing the spring to the base member in contrast to the prior art. Accordingly, it is not necessary to prepare an independent member for closing the aperture so that the manufacturing cost of the printer can be low.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Embodiments of the invention will now be described with reference to the drawings. In the following description and drawings, the same or corresponding portions bear the same reference numbers, and description thereof is not repeated.

First Embodiment

Figure 1:
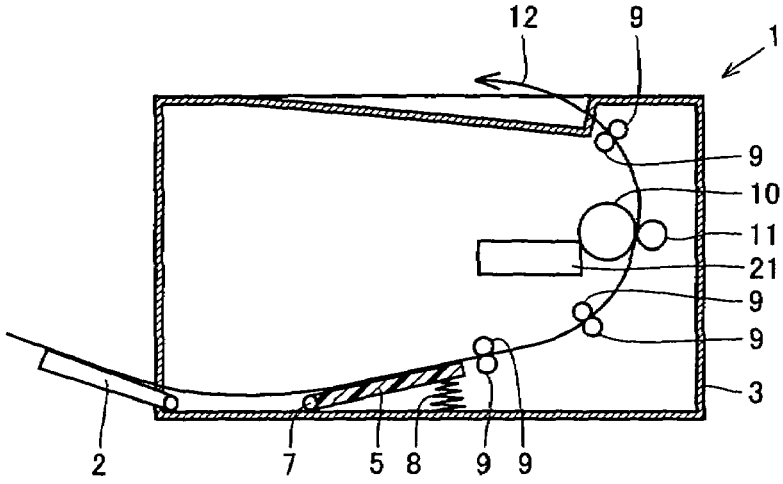
FIG. 1 is a schematic cross section showing a first embodiment of a printer according to the invention.

Referring to FIG. 1, description will now be given on a first embodiment of a printer according to the invention.

As shown in FIG. 1, a printer 1 according to the invention includes a guide 2 arranged at the rear of a casing 3, guide rolls 9 for transporting printing sheets of paper supplied from guide 2 into casing 3 through a predetermined path, a movable member 5 arranged to form a transporting path of the sheet for accurately engaging the sheet with guide rolls 9, a drum 10 for forming an image on the sheet moving as indicated by an arrow 12 and a toner cartridge 21 for supplying toner onto drum 10. Guide rolls 9, movable member 5, drum 10 and toner cartridge 21 are arranged inside casing 3. Movable member 5 is arranged on a bottom wall of casing 3. As will be described later, movable member 5 is rotatable around a rotation axis 7.

In printer 1 shown in FIG. 1, the sheet of recording paper supplied from guide 2 as indicated by arrow 12 is guided by an upper surface of movable member 5, and is engaged with guide rolls 9 for transportation. The transported sheet is supplied to a position between drum 10 and a transfer roll 11. A toner image made of toner supplied from toner cartridge 21 is formed on drum 10. Drum 10 comes into contact with the surface of the sheet so that the toner image formed on the surface of drum 10 is transferred onto the sheet. Thereafter, processing of fixing the toner image transferred onto the sheet and other processing are performed, and guide rolls 9 discharge the sheet bearing the image thus formed to a concave portion at the upper surface of printer 1 as indicated by arrow 12.

Figure 4:
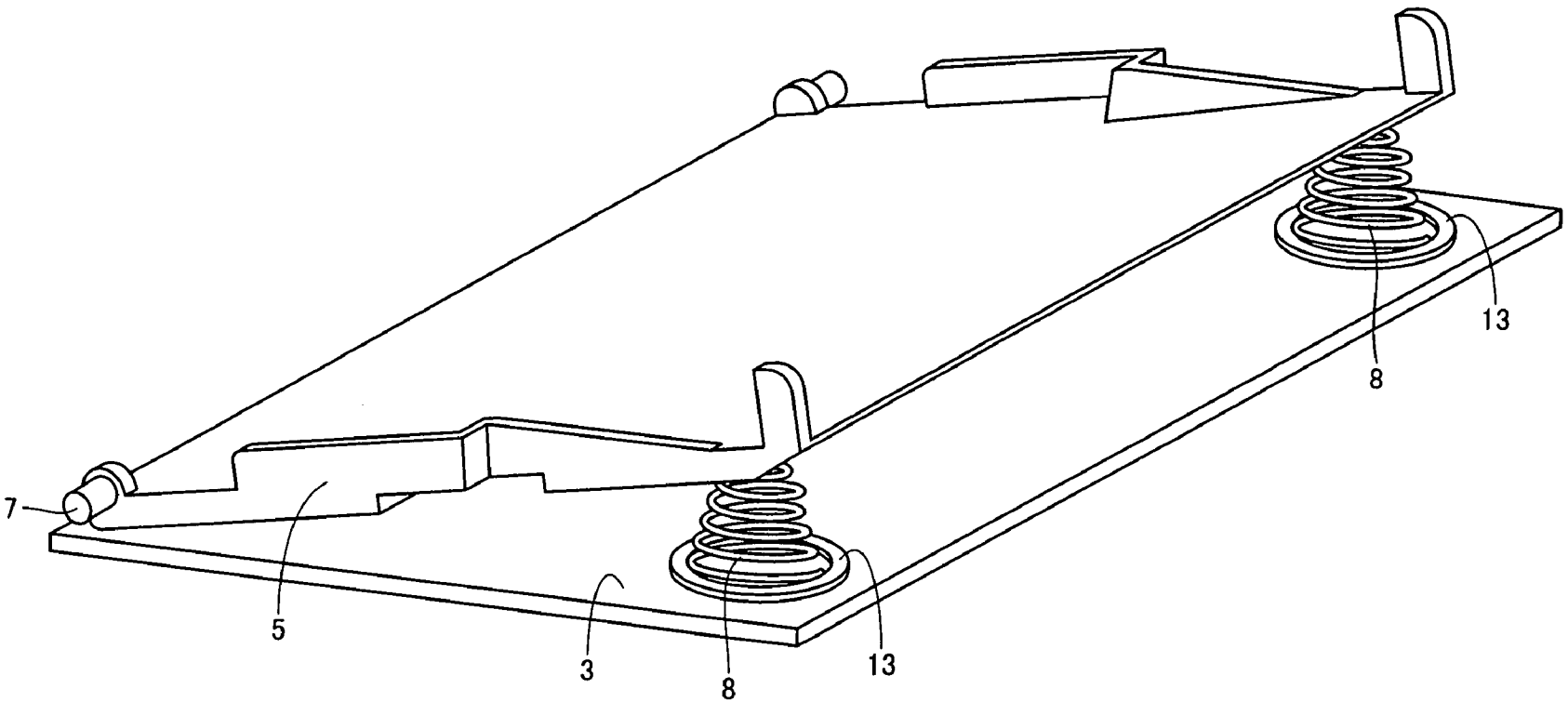
FIG. 4 is a schematic perspective view of the movable member shown in FIG. 2.
Figure 5:
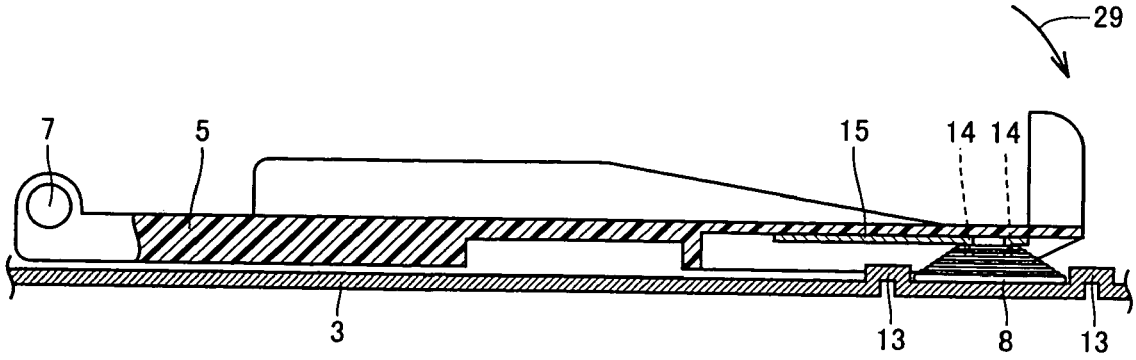
FIG. 5 is a schematic cross section showing a state of the movable member pressed to extend along a surface of the casing shown in FIG. 2.
Figure 6:
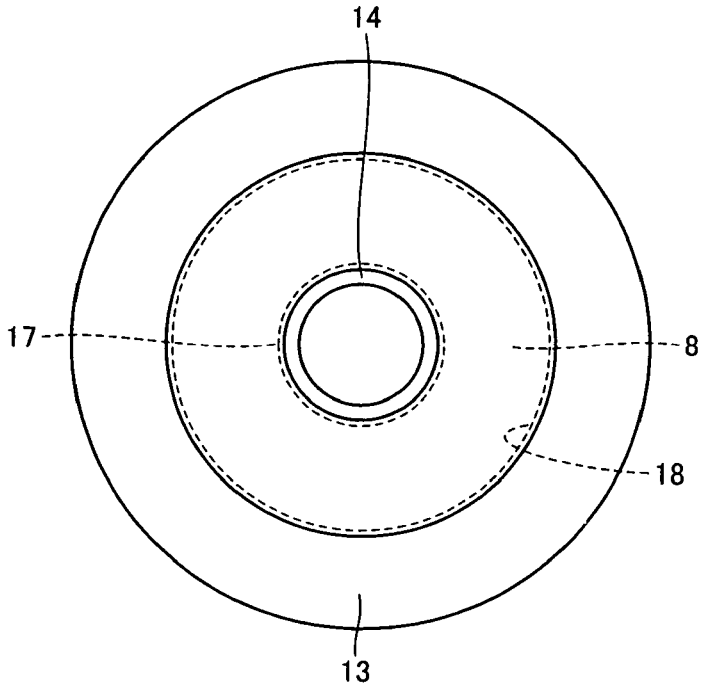
FIG. 6 is a schematic and perspective plan illustrating the connecting portions of the spring, the movable member and a bottom wall of the casing shown in FIG. 2.

Referring to FIGS. 2-6, description will now be given on structures of connecting portions of the movable member and the casing (i.e., structures for arranging the movable member) in the printer of the invention. FIG. 6 shows an arrangement of the spring viewed from the upper surface of the movable member.

Figure 2:
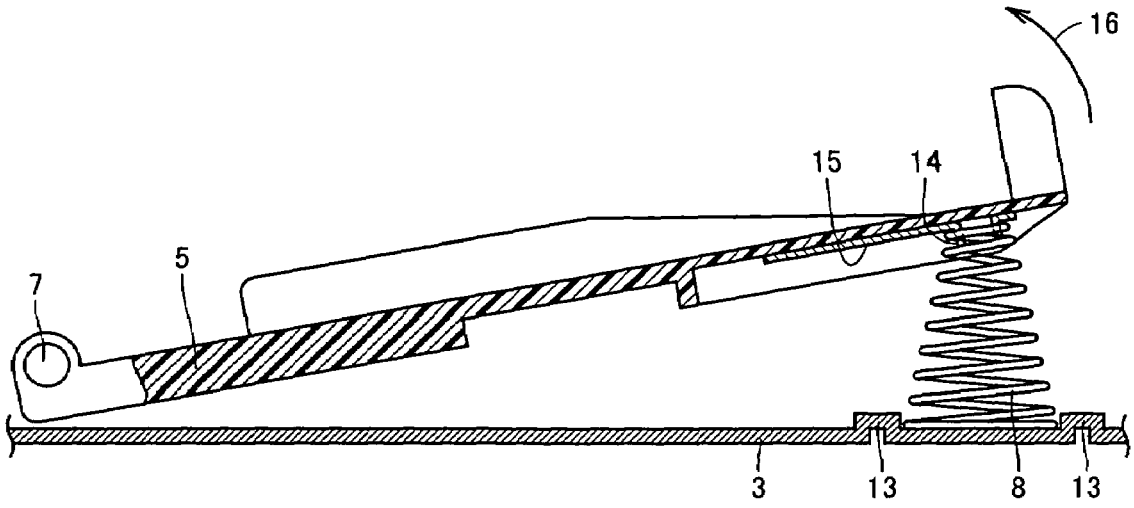
FIG. 2 is a schematic cross section showing, on an enlarged scale, structures of connecting portions of a spring, a movable member and a casing of the printer according to the invention.
Figure 3:
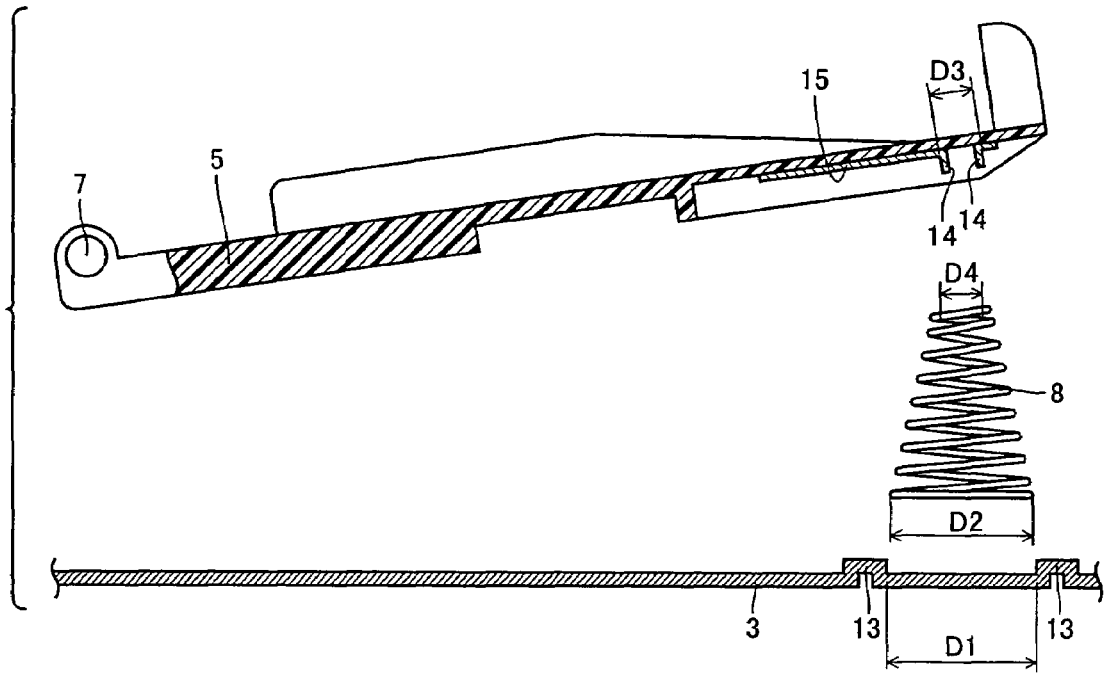
FIG. 3 is a schematic development illustrating the structures of the movable member and the casing shown in FIG. 2.

As shown in FIG. 2, movable member 5 is connected to casing 3, and is rotatable around rotation axis 7. Two springs 8 are arranged between movable member 5 and casing 3 as shown in FIG. 4. Each spring 8 is a coil spring having a conical outer form. Spring 8 may be an elastic member having an outer form other than the conical form. For example, it may be a coil spring having a uniform width (diameter) throughout its axial length. A lower end of spring 8 having a larger diameter is located on casing 3. For fixing spring 8 to the bottom wall of casing 3, casing 3 is provided at its bottom wall with circular convex portions 13 each having an annular form in a plan view. Each circular convex portion 13 has an inner diameter D1 larger than a diameter D2 of the lower end of spring 8. As can be seen from FIGS. 2 and 4, the lower end of spring 8 is arranged radially inside circular convex portion 13. Circular convex portion 13 can be easily formed by press working which is performed for forming casing 3.

A fixing member 15 is arranged on a rear surface of movable member 5 for fixing the upper ends of springs 8 to the rear surface of movable member 5. Fixing member 15 is provided with projected fixing portions 14 (i.e., projected portions for fixing) each having a circular form in a plan view. Projected fixing portions 14 can be formed by effecting usual machine working such as press working on fixing member 15. Projected fixing portion 14 has an outer diameter D3 smaller than an inner diameter D4 of the upper end of spring 8. When spring 8 is fixed in such a state that projected fixing portion 14 is inserted into the upper portion of spring 8. Consequently, movable member 5 is biased by springs 8 in a direction indicated by an arrow 16 around rotation axis 7 as shown in FIG. 2. Each spring 8 is positioned with respect to both of fixing member 15 and casing 3 so that the position of spring 8 can be fixed while holding springs 8 between movable member 5 and casing 3 without employing a manner of fixing spring 8 to the bottom wall of casing 3 with an adhesive.

When movable member 5 is pushed downward as indicated by an arrow 29 around rotation axis 7 as shown in FIG. 5, movable member 5 according to the invention can minimize a distance between movable member 5 and the bottom wall of casing 3 for the following reason. As shown in FIG. 6, projected fixing portion 14 on movable member 5 is arranged inside an inner diameter 17 of the upper end of each spring 8, and circular convex portion 13 of casing 3 has a larger size than an outer diameter 18 of the lower end of spring 8 so that each of projected fixing portion 14 of movable member 5 and the circular convex portion of casing 3 does not longitudinally or axially overlap with spring 8, and further projected fixing portion 14 and circular convex portion 13 do not overlap with each other. In principle, therefore, a minimum distance required between movable member 5 and casing 3 is equal to a thickness of compressed spring 8. Consequently, printer 1 employing movable member 5 can have small sizes.

Modifications of the structure of fixing spring 8 to movable member 5 or casing 3 will now be described.

Figure 7:
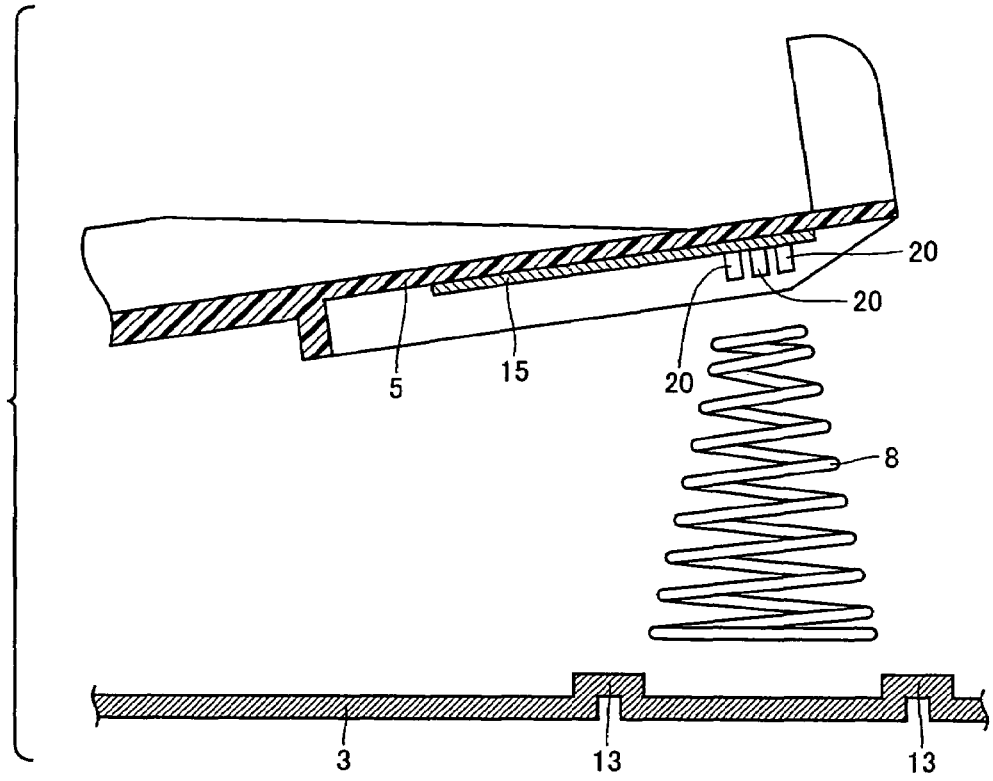
FIG. 7 is a schematic and fragmentary development showing a first modification of the first embodiment of the printer according to the invention.
Figure 8:
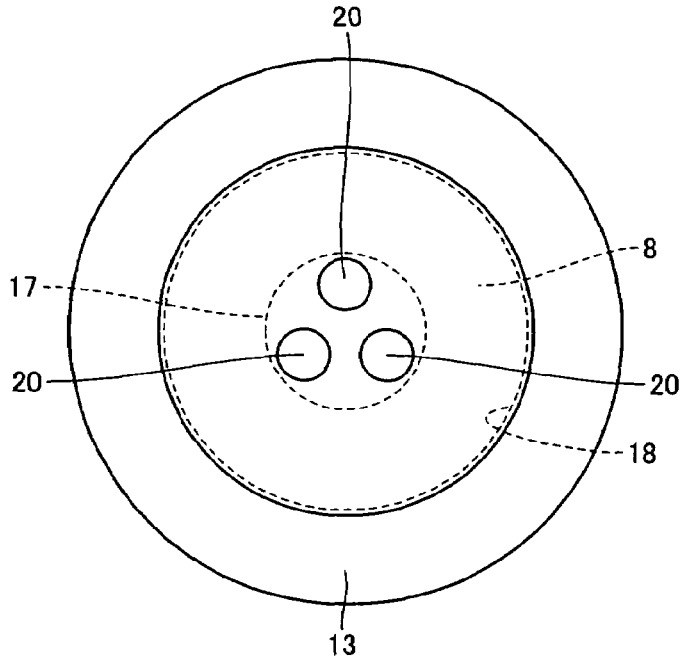
FIG. 8 is a schematic and perspective plan illustrating connecting portions of the spring, the movable member and the bottom wall of the casing of the printer shown in FIG. 7.

Referring to FIGS. 7 and 8, description will now be given on a first modification of the first embodiment of the printer according to the invention. FIG. 8 corresponds to FIG. 6.

As shown in FIGS. 7 and 8, the first modification of the first embodiment of the printer according to the invention has substantially the same basic structure as the printer shown in FIGS. 1 to 6 except for structures of connecting portions of movable member 5 and spring 8. More specifically, fixing member 15 arranged on the rear surface of movable member 5 is provided at a portion opposed to the upper end of each spring 8 with three convex portions 20. Each convex portion 20 has a cylindrical outer form. Convex portion 20 has a smaller diameter than inner diameter 17 of the upper end of spring 8 (see FIG. 8), and three convex portions 20 are all arranged radially inside inner diameter 17 of the upper end of corresponding coil spring 8. Thus, all convex portions 20 can be inserted into the upper end opening of spring 8. By inserting convex portions 20 into the upper end of spring 8, spring 8 can be connected and fixed to the rear surface of movable member 5, similarly to the printer shown in FIGS. 1 to 6.

Figure 9:
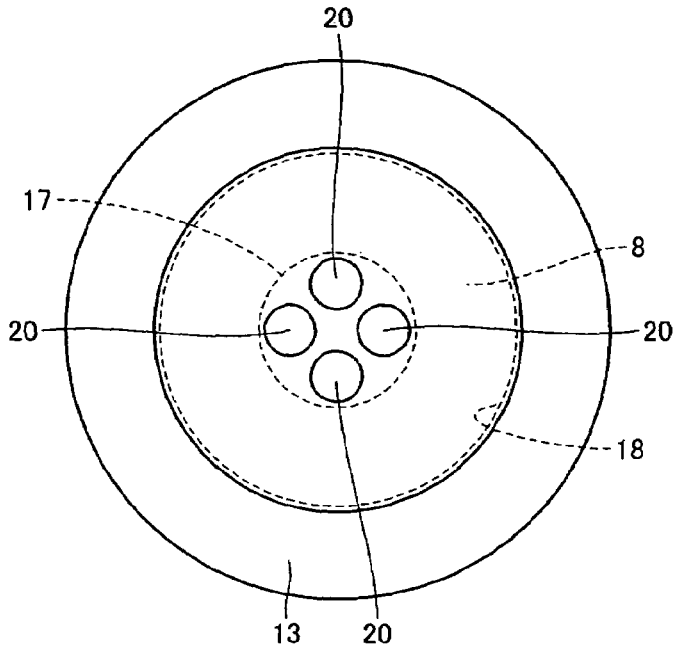
FIG. 9 is a schematic and perspective plan showing a second modification of the first embodiment of the printer according to the invention.

The number of convex portions 20 formed at fixing member 15 for each spring 8 are not restricted to three in contrast to those in FIG. 8, and may be two, four (see FIG. 9), five or more. Referring to FIG. 9, a second modification of the first embodiment of the printer according to the invention will now be described with reference to FIG. 9. FIG. 9 corresponds to FIG. 8.

A printer having a structure shown in FIG. 9 has substantially the same basic structure as that already described with reference to FIGS. 7 and 8 except for the number of convex portions 20 formed at fixing member 15. More specifically, fixing member 15 (see FIG. 7) of the printer shown in FIG. 9 is provided with four convex portions 20. Four convex portions 20 are all located inside inner diameter 17 of the upper end of the corresponding spring. This structure can achieve an effect similar to that of the printer shown in FIGS. 7 and 8.

Figure 10:
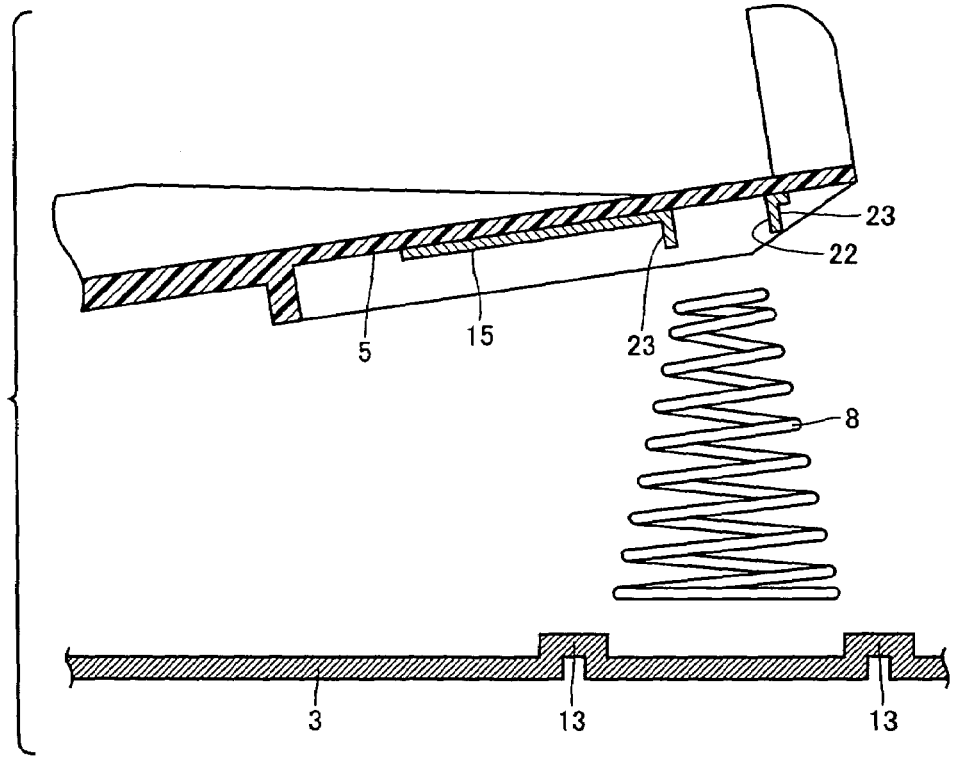
FIG. 10 is a schematic and perspective plan showing a third modification of the first embodiment of the printer according to the invention.
Figure 11:
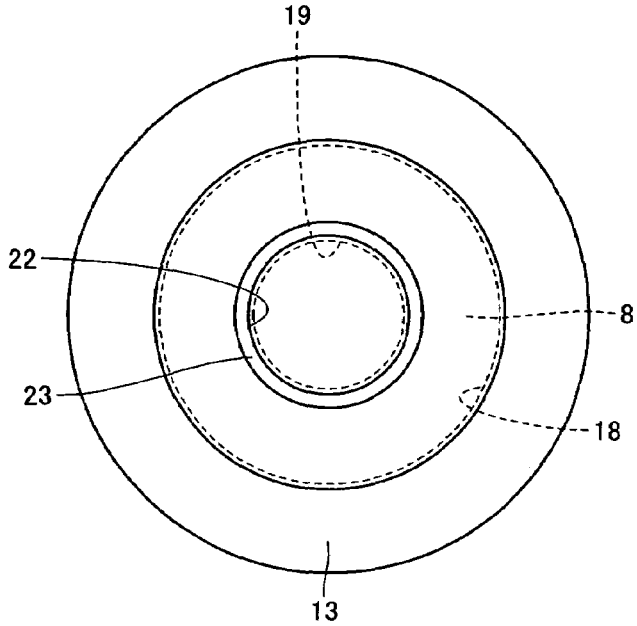
FIG. 11 is a schematic and perspective plan illustrating connecting portions of the spring, the movable member and the bottom wall of the casing of the printer shown in FIG. 10.

Referring to FIGS. 10 and 11, description will now be given on a third modification of the first embodiment of the printer according to the invention. FIGS. 10 and 11 correspond to FIGS. 7 and 8, respectively.

As can be seen from FIGS. 10 and 11, the third modification of the first embodiment of the printer according to the invention has substantially the same basic structure as the printer shown in FIGS. 1 to 6 except for structures of connecting portions of springs 8 and movable member 5. In the printer shown in FIGS. 10 and 11, fixing member 15 arranged on the rear surface of movable member 5 is provided with fixing openings 22 (i.e., openings for fixing) into which upper ends of springs 8 can be inserted, respectively. Fixing opening 22 is formed of an opening formed at fixing member 15 and a side wall 23 formed around the opening and extending from the front surface of fixing member 15. An inner diameter of fixing opening 22 in fixing member 15 is larger than an outer diameter 19 (see FIG. 11) of the upper end of spring 8. Therefore, the upper end of spring 8 is inserted into fixing opening 22 of fixing member 15 so that the position of spring 8 with respect to movable member 5 can be fixed. Consequently, an effect similar to that of the printer shown in FIGS. 1 to 6 can be achieved.

Figure 12:
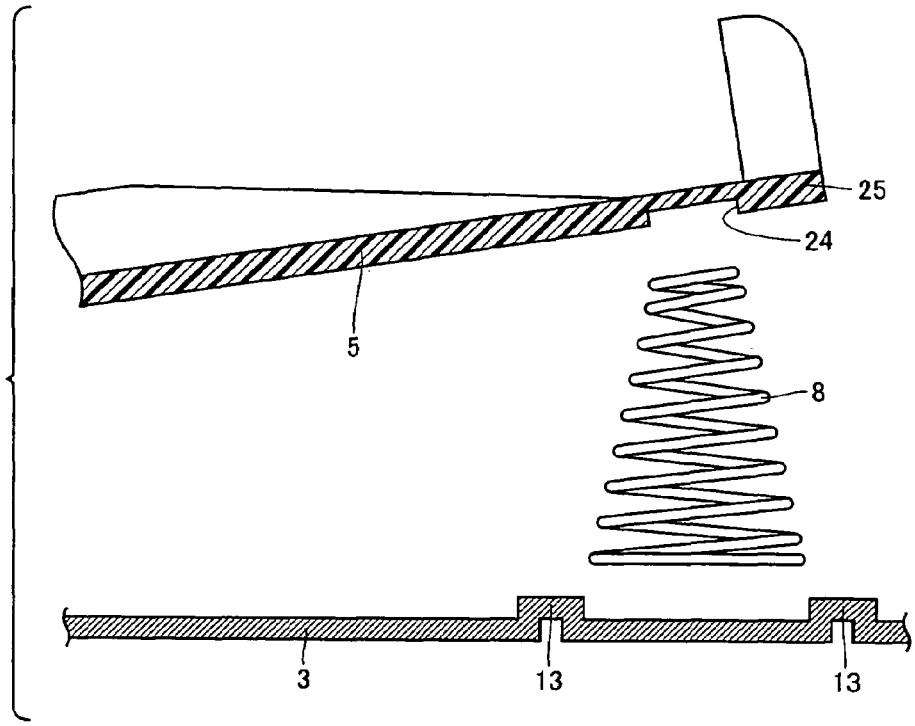
FIG. 12 is a schematic and fragmentary development showing a fourth modification of the first embodiment of the printer according to the invention.
Figure 13:
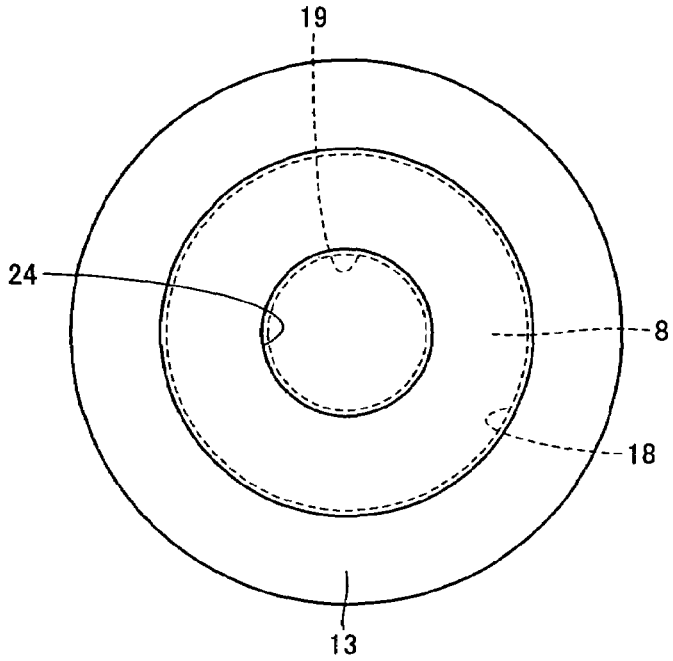
FIG. 13 is a schematic and perspective plan illustrating connecting portions of the spring, the movable member and the bottom wall of the casing of the printer shown in FIG. 12.

Referring to FIGS. 12 and 13, description will now be given on a fourth modification of the first embodiment of the printer according to the invention. FIGS. 12 and 13 correspond to FIGS. 7 and 8, respectively.

A printer shown in FIGS. 12 and 13 has substantially the same basic structure as the printer shown in FIGS. 10 and 11 except for structures of connecting portions of springs 8 and movable member 5. More specifically, a movable member bottom plate 25 forming movable member 5 is provided at its rear surface with concave portions 24. Each concave portion 24 has a diameter larger than outer diameter 19 of the upper end of the spring as shown in FIG. 13. Therefore, the upper end of spring 8 is inserted into concave portion 24 so that the position of spring 8 is fixed with respect to movable member 5. By forming concave portion 24 directly at the movable member bottom plate 25, it is possible to achieve the effect similar to that of the structure using fixing member 15 provided with fixing openings 22 as shown in FIGS. 10 and 11.

As compared with the structure which is shown in FIGS. 10 and 11, the structure shown in FIGS. 12 and 13 is not provided with side wall 23 shown in FIG. 10, and this difference can reduce a space which is defined between movable member 5 and casing 3 when movable member 5 is pushed toward casing 3. Consequently, the sizes of the printer can be further reduced.

Second Embodiment

Figure 14:
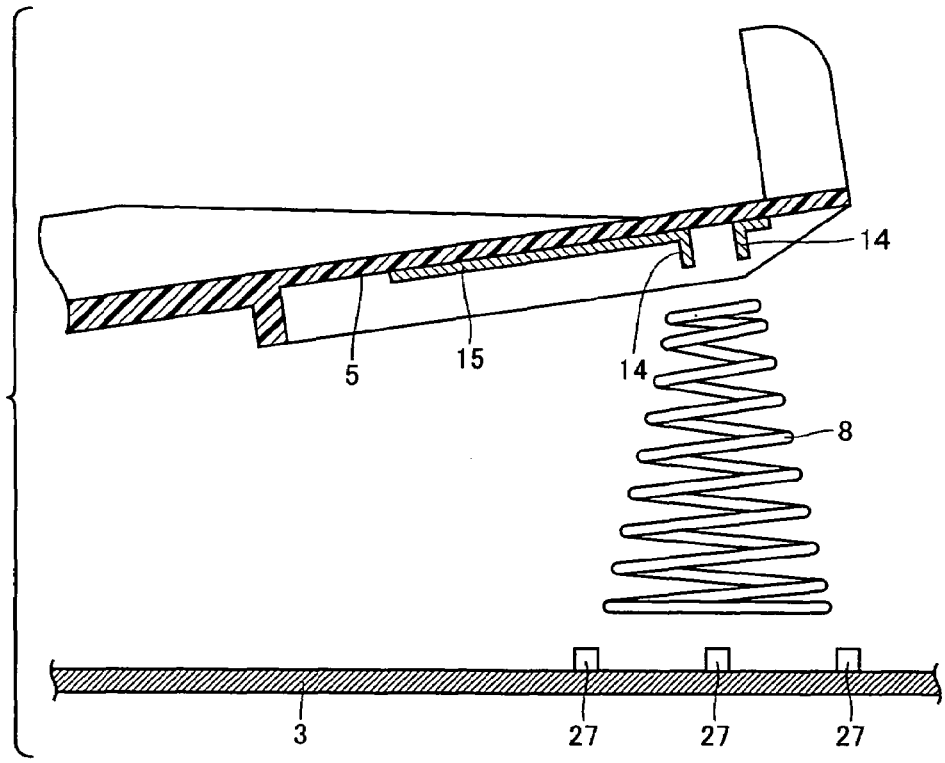
FIG. 14 is a schematic and fragmentary development showing a second embodiment of the printer according to the invention.
Figure 15:
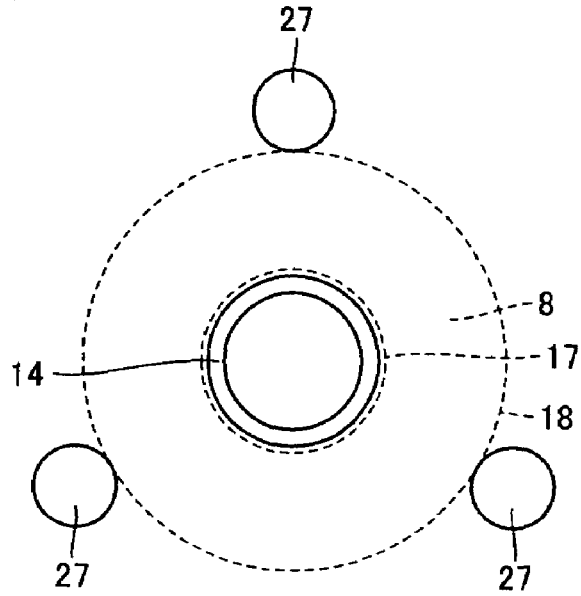
FIG. 15 is a schematic and perspective plan illustrating connecting portions of the spring, the movable member and the bottom wall of the casing of the printer shown in FIG. 14.

Referring to FIGS. 14 and 15, a second embodiment of the printer according to the invention will now be described. FIGS. 14 and 15 correspond to FIGS. 7 and 8, respectively.

A printer shown in FIGS. 14 and 15 has substantially the same basic structure as the printer shown in FIGS. 1 to 6 except for structures of connecting portions of springs 8 and casing 3. More specifically, instead of circular convex portion 13 shown in FIG. 2, casing 3 is provided at the surface of its bottom wall with three lower fixing convex portions 27 (i.e., convex portions 27 for fixing the lower end) which are arranged around corresponding spring 8. Three lower fixing convex portions 27 are in contact with the lower end of spring 8, and are equally spaced from each other in the direction along the outer periphery of the lower end of spring 8. This structure can likewise fix the position of spring 8 with respect to casing 3. Lower fixing convex portion 27 may be spaced from outer diameter 18 of the lower end of the spring, and thus may not be in contact with the lower end of spring 8.

Each lower fixing convex portion 27 has a cylindrical form as shown in the figure, but may have another form. For example, lower fixing convex portion 27 may have a prismatic form) a plate-like form or a form having a surface curved along the outer diameter of the lower end of spring 8.

Figure 16:
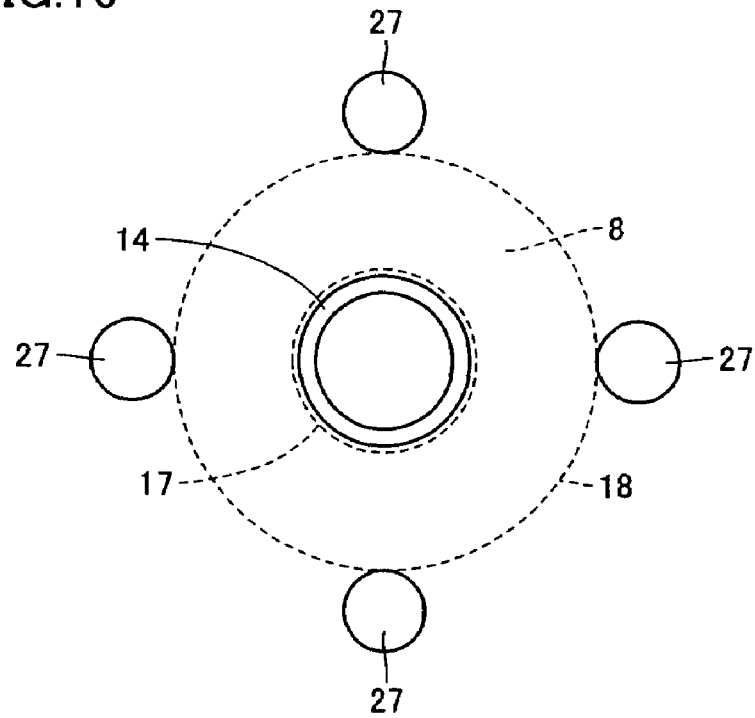
FIG. 16 is a schematic and perspective plan illustrating connecting portions of a spring, a movable member and a bottom wall of a casing in a first modification of the second embodiment of the printer of according to the invention shown in FIGS. 14 and 15.

Referring to FIG. 16, description will now be given on a first modification of the second embodiment of the printer according to the invention. FIG. 16 corresponds to FIG. 15.

A printer shown in FIG. 16 has substantially the same basic structure as the printer shown in FIGS. 14 and 15 except for the number of lower fixing convex portions 27 for fixing the position of spring 8 with respect to casing 3. More specifically, the printer shown in FIG. 16 is provided with four lower fixing convex portions 27 located around each spring 8. Lower fixing convex portions 27 shown in FIG. 16 surround spring 8, and are equally spaced from each other in the direction along the outer periphery of the lower end of spring 8. This structure can achieve an effect similar to that of the printer shown in FIGS. 14 and 15. The number of lower fixing convex portions 27 is not restricted to four (FIG. 16) or three (FIG. 15), and may be two, five or more.

Figure 17:
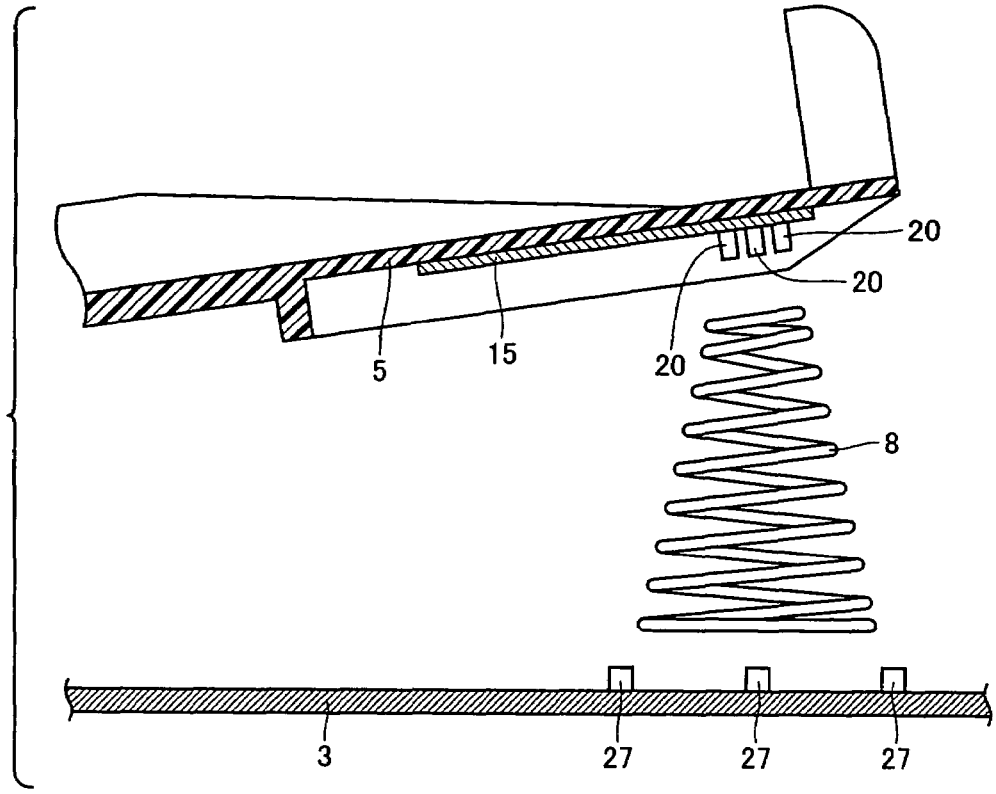
FIG. 17 is a schematic and fragmentary development showing a second modification of the second embodiment of the printer according to the invention.
Figure 18:
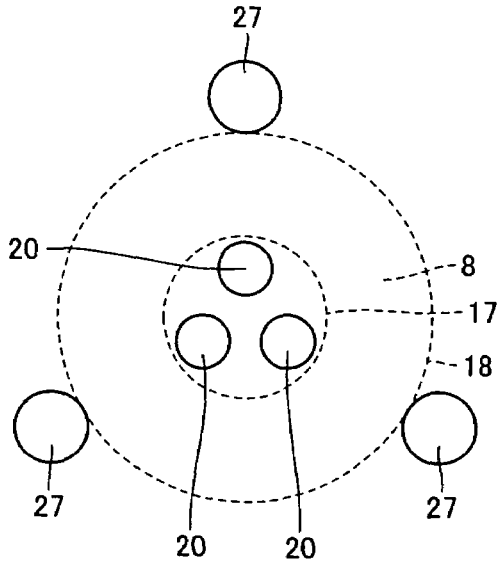
FIG. 18 is a schematic and perspective plan illustrating connecting portions of the spring, the movable member and the bottom wall of a casing of the printer shown in FIG. 17.

Referring to FIGS. 17 and 18, description will now be given on a second modification of the second embodiment of the printer according to the invention. FIGS. 17 and 18 correspond to FIGS. 7 and 8, respectively.

A printer shown in FIGS. 17 and 18 has substantially the same basic structure as the printer shown in FIGS. 14 and 15 except for structures of connecting portions of springs 8 and movable member 5. More specifically, fixing member 15 is arranged on a portion of the lower surface of movable member 5 opposed to springs 8, and fixing member 15 is provided at its lower surface with three convex portions 20 located at each of the positions opposed to respective springs 8. These convex portions 20 have substantially the same basic structures as convex portions 20 shown in FIGS. 7 and 8. These convex portions 20 can fix the relative positions of springs 8 with respect to movable member 5 similarly to projected fixing portions 14 in the printer shown in FIGS. 14 and 15.

Figure 19:
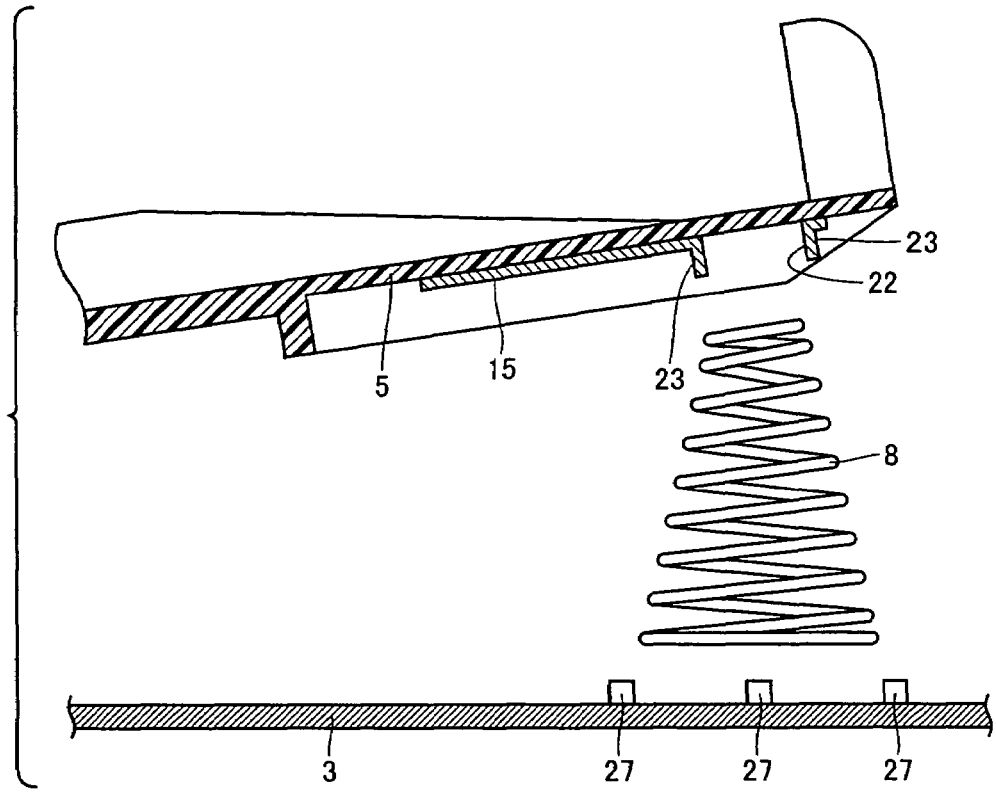
FIG. 19 is a schematic and fragmentary development showing a third modification of the second embodiment of the printer according to the invention.
Figure 20:
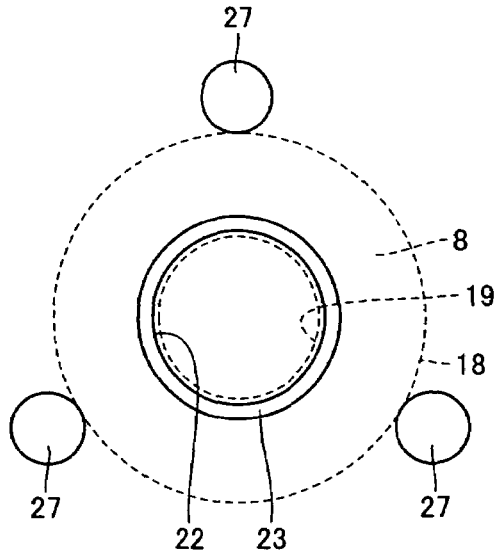
FIG. 20 is a schematic and perspective plan illustrating connecting portions of the spring, the movable member and the bottom wall of the casing of the printer shown in FIG. 19.

Referring to FIGS. 19 and 20, description will now be given on a third modification of the second embodiment of the printer according to the invention. FIGS. 19 and 20 correspond to FIGS. 7 and 8, respectively.

A printer shown in FIGS. 19 and 20 has substantially the same basic structure as the printer shown in FIGS. 14 and 15 except for structures of connecting portions of springs 8 and movable member 5. More specifically, fixing member 15 arranged on the rear surface of movable member 5 is provided with fixing openings 22 each having a larger inner diameter than an outer diameter of the upper end of spring 8. Thus, fixing opening 22 defined by side wall 23 has an inner diameter larger than outer diameter 19 of the upper end of spring 8 as shown in FIG. 20. Therefore, the upper end of spring 8 can be inserted into fixing opening 22. Consequently, spring 8 can be positioned with respect to movable member 5. This structure can likewise achieve the effect similarly to the printer shown in FIGS. 14 and 15.

The embodiments of the invention will now be enumerated although some of the foregoing descriptions will be repeated.

Printer 1 according to the invention includes the mechanism of positioning springs 8, and further includes casing 3, movable member 5 and springs 8, i.e., coil springs as shown in FIGS. 1 to 6. Movable member 5 is arranged on the bottom wall of casing 3. Movable member 5 is employed for restricting the transportation path of the printing sheets indicated by arrow 12 in FIG. 1. Spring 8 has a conical form, and is located between casing 3 and movable member 5. Spring 8 is employed for biasing movable member 5 away from the bottom wall of casing 3. Casing 3 is provided at its bottom wall with circular convex portions 13 each of which is formed of the projected portion projected toward corresponding spring 8, and is located at a position opposed to one end (lower end) of spring 8 having a larger width. Circular convex portion 13 is annular in a plan view. The one end (lower end) of spring 8 is arranged radially inside circular convex portion 13 so that the position of spring 8 is fixed with respect to casing 3. Movable member 5 is provided with projected fixing portions 14 serving as the fixing portions and each located at the position opposed to the other end (upper end) of corresponding spring 8 remote from the one end (lower end). Projected fixing portion 14 is employed for fixing the upper end of spring 8. Projected fixing portion 14 formed at movable member 5 is the convex portion projected toward spring 8 and having a circular plane form extending along the plane form of the inner periphery of the other end (upper end) of spring 8. The convex portion which is projected fixing portion 14 is located radially inside spring 8 when movable member 5 is connected to spring 8.

Printer 1 according to the invention includes the positioning mechanism for springs 8, and includes casing 3 serving as the base member, movable member 5 and springs 8. Movable member 5 is movable with respect to casing 3. Springs 8 are located between casing 3 and movable member 5. Each spring 8 is employed for biasing movable member 5 away from casing 3. Casing 3 is provided at a position opposed to one end (lower end) of each spring 8 with the projected portion (circular convex portion 13 or lower fixing convex portions 27) which projects toward spring 8 and is arranged to pinch the one end (lower end) of spring 8. The one end (lower end) of spring 8 is held by the projected portion (i.e., the lower end of spring 8 is arranged radially inside circular convex portion 13, or is surrounded by the plurality of lower fixing convex portions 27) so that the position of spring 8 is fixed with respect to casing 3. Movable member 5 is provided at the position opposed to the other end (upper end) of spring 8 remote from the one end (lower end) with the fixing portion (projected fixing portion 14, convex portions 20, fixing opening 22 or concave portion 24) for fixing the other end (upper end) of spring 8.

In this manner, spring 8 is connected to two portions, i.e., the projected portion (circular convex portion 13 or lower fixing convex portions 27) of casing 3 serving as the base member and the fixing portion (projected fixing portion 14, convex portions 20, fixing opening 22 or concave portion 24) of movable member 5. Therefore, it is not necessary to form an aperture or the like in casing 3 for fixing spring 8 in contrast to the prior art. Therefore, it is not necessary to prepare an independent member for closing the aperture. Since spring 8 is fixed at two portions, i.e., the upper and lower ends, it is not necessary to apply an adhesive or the like to the contact portions in contrast to the case where spring 8 is fixed only at the contact portions of casing 3 and spring 8. Consequently, the manufacturing cost of printer 1 can be reduced. Accordingly, it is possible to provide inexpensive printer 1.

In the prior art, a convex portion for fixing is formed at spring 8, and spring 8 is arranged on casing 3 by engaging the spring end with an engagement portion of casing 3 and inserting the convex portion of spring 8 into an aperture of casing 3. However, these relatively complicated operations are not required according to the invention so that the manufacturing steps of printer 1 can be simple. In the prior art, it has been considered that spring 8 must be reliably connected to either casing 3 or movable member 5 by adhering it with an adhesive or by fixedly inserting the convex portion into the aperture. This is probably because those skilled in the art have considered that disadvantages such as disengagement of spring 8 from a predetermined position may occur during the operation of the printer unless spring 8 is not reliably fixed, e.g., with the adhesive. Accordingly, those skilled in the art have not given consideration to the structure in which spring 8 is held between casing 3 and movable member 5 but neither casing 3 nor movable member 5 is adhered to spring 8. However, the inventors have studied the conditions of use of spring 8, and have completed the invention by finding that the even the structure having spring 8 held between casing 3 and movable member 5 can sufficiently stably hold spring 8.

In printer 1, the projected portion (projected fixing portion 14) of casing 3 may have an annular form in a plan view as shown in FIGS. 4, 6, 8, 9, 11 and 11. Inner diameter D1 of the annular projected portion (projected fixing portion 14) may be larger than the width (diameter D2 shown in FIG. 3) of the one end (lower end) of spring 8.

In this case, spring 8 is arranged such that the one end (lower end) of spring 8 is fitted into the annular projected portion (projected fixing portion 14), and thereby the annular projected portion (projected fixing portion 14) restricts the movement of spring 8 so that the relative position of spring 8 with respect to casing 3 can be easily fixed. The foregoing annular projected portion (projected fixing portion 14) can be formed by effecting relatively simple working such as press working on the bottom wall of casing 3. Therefore, it is possible to suppress complication of the manufacturing steps of printer 1 so that increase in manufacturing cost of printer 1 can be suppressed.

In printer 1, the projected portion of casing 3 may be formed of a plurality of positioning projections (lower fixing convex portions 27 shown in FIGS. 14 to 20) arranged to pinch the one end (lower end) of spring 8. In this case, lower fixing convex portions 27 pinch (surround) the one end (lower end) of spring 8 to restrict the movement of spring 8 so that the relative position of spring 8 with respect to casing 3 can be easily fixed.

In printer 1 described above, casing 3 is preferably provided with three of more positioning projections (lower fixing convex portions 27). Preferably, all lower fixing convex portions 27 are equally spaced from each other in the direction along the outer periphery of the one end (lower end) of spring 8. In this case, three of more lower fixing convex portions 27 can surround the one end (lower end) of spring 8 so that the relative position of spring 8 with respect to casing 3 can be reliably fixed.

In printer 1 described above, the fixing portion (projected fixing portion 14 or convex portions 20) formed at movable member 5 may be a convex portion projected toward the spring. Spring 8 may be a coil spring. Movable member 5 and spring 8 may be connected in such a state that projected fixing portion 14 or convex portions 20 are inserted into the upper end of spring 8. In this case, the relative simple structure that projected fixing portion 14 or convex portions 20 of movable member 5 are inserted into spring 8 can restrict lateral movement of spring 8 with respect to movable member 5. Consequently, the position of spring 8 with respect to movable member 5 can be fixed. Further, projected fixing portion 14 or convex portions 20 of movable member 5 are inserted into spring 8, and the projected portion (circular convex portion 13 or lower fixing convex portions 27) of casing 3 is arranged to pinch the one end (lower end) of spring 8, and thus is arranged radially outside spring 8. Therefore, when movable member 5 is pushed toward casing 3, projected fixing portion 14 or convex portions 20 of movable member 5 do not overlap (and thus do not come into contact) with circular convex portion 13 or lower fixing convex portions 27 of casing 3. Accordingly, the distance between casing 3 and movable member 5 can be reduced to a value smaller than a sum of a height of projected fixing portion 14 or convex portion 20 of movable member 5 and a height of circular convex portion 13 or lower fixing convex portions 27 of casing 3. Consequently, a volume required for arranging movable member 5 on the bottom wall of casing 3 can be smaller than that in the case where the convex portion (projected fixing portion 14 or convex portions 20) of movable member 5 and the projected portion (circular convex portion 13 or lower fixing convex portions 27) of casing 3 overlap with each other. Accordingly, the sizes of printer 1 can be reduced.

In printer 1, the convex portion (projected fixing portion 14) of movable member 5 may have a plane form extending along a plane form of the inner periphery of the other end (upper end) of spring 8. The size of the convex portion (projected fixing portion 14) may be determined such that the outer peripheral surface of the convex portion (projected fixing portion 14) may be in contact with the inner peripheral surface of the other end (upper end) of spring 8. When the convex portion (projected fixing portion 14) of movable member 5 is inserted into the other end (upper end) of spring 8, the above structure can remarkably suppress rattling of the convex portion (projected fixing portion 14) inserted into the other end (upper end) of spring 8. Further, the relative positions of movable member 5 and spring 8 can be reliably fixed owing to the contact of the convex portion (projected fixing portion 14) with spring 8.

In printer 1 already described, convex portions 20 may include the plurality of columnar projections projecting from the surface of movable member 5 toward the spring. The columnar projections (convex portions 20) are preferably arranged such that these projections may be in contact with portions of the inner peripheral surface of the other end (upper end) of spring 8. In this case, the position of spring 8 with respect to movable member 5 can be easily determined by inserting the columnar projections (convex portions 20) into the other end (upper end) of spring 8.

In printer 1, the columnar projections (convex portions 20) are preferably three or more in number. In this case, each columnar projection (convex portion 20) is preferably arranged to be in contact with the inner peripheral surface of the other end (upper end) of spring 8. In this case, it is possible to prevent reliably the shifting of the relative position of the spring with respect to movable member 5 so that the position of spring 8 with respect to movable member 5 can be accurately determined.

In printer 1, it is preferable that the height of the convex portion (projected fixing portion 14 or convex portions 20) measured from the surface of movable member 5 is smaller than the height of spring 8 in the compressed state. This structure can prevent the contact of the convex portion (projected fixing portion 14 or convex portions 20) with the surface of the bottom wall of casing 3 when movable member 3 is pushed toward casing 3. Therefore, such a problem can be prevented that the distance between movable member 5 and the bottom wall of casing 3 cannot be smaller than the height of the convex portion (projected fixing portion 14 or convex portions 20) due to an excessively large height of the convex portion.

In printer 1 described above, as shown in FIGS. 10-13, 19 and 20, the fixing portion formed at movable member 5 may be the concave portion (fixing opening 22 or concave portion 24) which has a larger width than the other end (upper end) of spring 8, and is formed at movable member 5. Movable member 5 and spring 8 may be connected together in such a state that the other end (upper end) of spring 8 is inserted into the concave portion (fixing opening 22 or concave portion 24). In this case, the fixing portion for fixing spring 8 can be formed at movable member 5 by simple working of forming the concave portion (fixing opening 22 or concave portion 24) at movable member 5. Also, the position of spring 8 can be fixed with respect to movable member 5 by the simple operation of inserting the other end (tip end) of spring 8 into the concave portion (fixing opening 22 or concave portion 24).

In printer 1 described above, spring 8 may be a conical coil spring. In this case, the height of spring 8 which is compressed by pushing movable member 5 toward casing 3 can be smaller than that in a structure using a coil spring having a uniform coil radius throughout its length along the coil axis. Consequently, the distance between movable member 5 and the bottom wall of casing 3 can be reduced. Spring 8 may be selectively formed of elastic members having various forms instead of the foregoing conical coil spring.

In printer 1 described above, the base member may be a bottom wall of the external body (bottom wall of casing 3) of the printer. In this case, the components of printer 1 can be smaller in number than those in a structure employing a member independent of casing 3 of the printer as the base member. Since the bottom wall of casing 3 serves also as the base member, the volume of printer 1 can be smaller than that in the structure employing the independent member as the base member.

Printer 1 according to the invention includes a positioning mechanism for spring 8 which will be described below, and particularly includes casing 3 as a base member, movable member 5 and spring 8. Movable member 5 is movable with respect to casing 3. Spring 8 is located between the bottom wall of casing 3 and movable member 5. Spring 8 is employed for biasing movable member 5 away from casing 3. Casing 3 and spring 8 are not fixed adhered together, but are connected together to restrict changes in relative position of spring 8 with respect to casing 3 in the direction along the surface of the bottom wall of casing 3. For example, the lower end of spring 8 is arranged radially inside circular convex portion 13 of casing 3, and this arrangement restricts the movement of spring 8 in the direction along the surface of the bottom wall of casing 3. Movable member 5 and spring 8 are not adhered together, but are connected together to restrict changes in relative position of spring 8 with respect to movable member 5 in the direction along the surface of movable member 5. For example, projected fixing portion 14 of movable member 5 is inserted into the upper end of spring 8, and this arrangement restricts the movement of spring 8 in the direction along the surface of movable member 5. Spring 8 is held between casing 3 and movable member 5.

In the above structure, the movement of spring 8 in the direction along the surface of the bottom wall of casing 3 or in the direction along the surface of movable member 5 is restricted by the two portions, i.e., the projected portion (circular convex portion 13 or lower fixing convex portions 27) of casing 3 and the fixing portion (projected fixing portion 14, convex portions 20, fixing opening 22 or concave portion 24) of movable member 5. Therefore, spring 8 can be stably held by keeping spring 8 between casing 3 and movable member 5. Accordingly, it is not necessary to form an aperture or the like at casing 3 for fixing spring 8 in contrast to the prior art, and thus it is not necessary to prepare an independent member for closing the aperture. Further, spring 8 is held at the two portions, i.e., upper and lower portions so that it is not necessary to arrange an adhesive or the like on contact portions of casing 3 and spring 8 in contrast to the case where spring 8 is fixed only by such contact portions. Consequently, the manufacturing cost of printer 1 can be reduced. Accordingly, it is possible to achieve inexpensive printer 1.

The invention can be applied to the printer in which the movable member is movably arranged in the cassette body or the casing of the printer, and is biased by the spring for restricting the transportation path of printing sheets within the cassette of the printing sheets or within the transportation path of the printing sheets. Further, the positioning mechanism of the spring can be applied to devices other than the printer, and particularly to devices of structures each having a spring held between a base member and a movable member. The devices other than the printer may be electronic devices such as a copying machine or a facsimile.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A printer comprising: a casing;

a movable member arranged on a bottom wall of said casing for restricting a transportation path of printing sheets; and a coil spring having a conical form and located between said casing and said movable member for biasing said movable member away from said bottom wall, wherein said casing is provided at said bottom wall with a projected portion having an annular form, projected toward said coil spring and located at a position opposed to one end of said spring having a larger width, said one end of said coil spring is arranged radially inside said projected portion to fix the position of said coil spring with respect to said casing, said movable member is provided at a position opposed to the other end of said coil spring remote from said one end with a fixing portion for fixing said other end of said coil spring, said fixing portion formed at said movable member is a convex portion projected toward said coil spring, and having a circular form extending along a form of an inner periphery of said other end of said coil spring, said movable member is connected to said coil spring with said convex portion inserted into said coil spring, and said convex portion is positioned inside said projected portion when said coil spring is compressed such that said convex portion does not overlap with said projected portion.

2. A printer comprising:

a base member;

a movable member movable with respect to said base member; and a spring located between said base member and said movable member for biasing said movable member away from said base member, wherein said base member is provided at a position opposed to one end of said spring with a projected portion projected toward said spring and located to pinch said one end of said spring, the pinching of said one end of said spring by said projected portion fixes the position of said spring with respect to said base member, said movable member is provided at a position opposed to the other end of said spring remote from said one end with a fixing portion for fixing said other end of said spring, and said fixing portion is positioned inside said projected portion when said coil spring is compressed such that said fixing portion does not overlap with said projected portion.

3. The printer according to claim 2, wherein said projected portion of said base member has an annular form, and an inner periphery of said annular projected portion has a diameter larger than a width of said one end of said spring.

4. The printer according to claim 2, wherein said projected portion of said base member is formed of a plurality of positioning projections arranged to pinch said one end of said spring.

5. The printer according to claim 2, wherein said fixing portion formed at said movable member is a convex portion projected toward said spring, said spring is a coil spring, and said movable member and said spring are connected together in such a state that said convex portion is inserted into said spring.

6. The printer according to claim 5, wherein said convex portion has a form extending along a form of an inner periphery of said other end of said spring.

7. The printer according to claim 2, wherein said fixing portion formed at said movable member is a concave portion formed at said movable member and having a larger width than said other end of said spring.

8. The printer according to claim 2, wherein said spring is a conical coil spring.

9. The printer according to claim 2, wherein said base member is a bottom wall of an external body of the printer.

10. A printer comprising:

a base member;

a movable member movable with respect to said base member; and a spring located between said base member and said movable member for biasing said movable member away from said base member, wherein said base member is provided at a position opposed to one end of said spring with a projected portion projected toward said spring and located to pinch said one end of said spring, the pinching of said one end of said spring by said projected portion fixes the position of said spring with respect to said base member, said movable member is provided at a position opposed to the other end of said spring remote from said one end with a fixing portion for fixing said other end of said spring, said fixing portion formed at said movable member is a convex portion projected toward said spring, said spring is a coil spring, and said movable member and said spring are connected together in such a state that said convex portion is inserted into said spring, and said convex portion includes a plurality of columnar projections projecting from a surface of said movable member toward said spring.

11. A printer comprising:

a base member having a projected portion;

a movable member movable with respect to said base member having a fixing portion; and a spring located between said projected portion and said fixing portion for biasing said movable member away from said base member, wherein said base member and said spring are not adhered together, and are connected together to restrict changes in relative position of said spring with respect to said base member in a direction along a surface of said base member, said movable member and said spring are not adhered together, and are connected together to restrict changes in relative position of said spring with respect to said movable member in a direction along a surface of said movable member, said spring is held between said base member and said movable member, and said fixing portion is positioned inside said projected portion when said coil spring is compressed such that said fixing portion does not overlap with said projected portion.

* * * * *